US006863389B2

(12) United States Patent
Merz et al.

(10) Patent No.: US 6,863,389 B2
(45) Date of Patent: Mar. 8, 2005

(54) LIQUID INK CARTRIDGE USING VISCOUS GEL

(75) Inventors: Eric A. Merz, Palmyra, NY (US); Juan Becerra, Altamont, NY (US); Jeffrey M. Koff, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 100 days.

(21) Appl. No.: 10/342,387

(22) Filed: Jan. 15, 2003

(65) Prior Publication Data

US 2004/0135862 A1 Jul. 15, 2004

(51) Int. Cl.[7] ..... B41J 2/175

(52) U.S. Cl. ..... 347/86; 347/85; 347/87; 347/88; 347/89

(58) Field of Search ..... 347/85–89

(56) References Cited

U.S. PATENT DOCUMENTS

| | | | | |
|---|---|---|---|---|
| 3,526,522 | A | 9/1970 | Seregely | |
| 3,656,857 | A | 4/1972 | Seregely | |
| 5,398,989 | A | 3/1995 | Winter et al. | |
| 5,874,488 | A | 2/1999 | Wang et al. | |
| 5,896,151 | A | 4/1999 | Miyazawa et al. | |
| 6,028,126 | A | 2/2000 | Wang et al. | |
| 6,132,124 | A | 10/2000 | Ogura et al. | |
| 6,145,970 | A | 11/2000 | Sasaki et al. | |
| 6,200,053 | B1 | 3/2001 | Asami et al. | |
| 6,250,749 | B1 | 6/2001 | Merz et al. | |
| 6,254,226 | B1 | 7/2001 | Lengyel et al. | |
| 6,264,319 | B1 | 7/2001 | Altfather et al. | |
| 6,402,308 | B1 | 6/2002 | Hattori et al. | |
| 6,431,695 | B1 * | 8/2002 | Johnston et al. | 347/86 |

* cited by examiner

*Primary Examiner*—Stephen D. Meier
*Assistant Examiner*—Ly T Tran
(74) *Attorney, Agent, or Firm*—Oliff & Berridge, PLC

(57) ABSTRACT

A liquid ink cartridge, such as ink jet ink cartridge, includes a container defining an ink reservoir, the ink reservoir having an ink outlet at one end and capable of receiving a supply of ink in the ink reservoir; and an ink follower composition located in the ink reservoir apart from the ink outlet. The ink follower composition includes a viscous gel material that provides a negative pressure in the ink reservoir.

20 Claims, 1 Drawing Sheet

FIG. 1
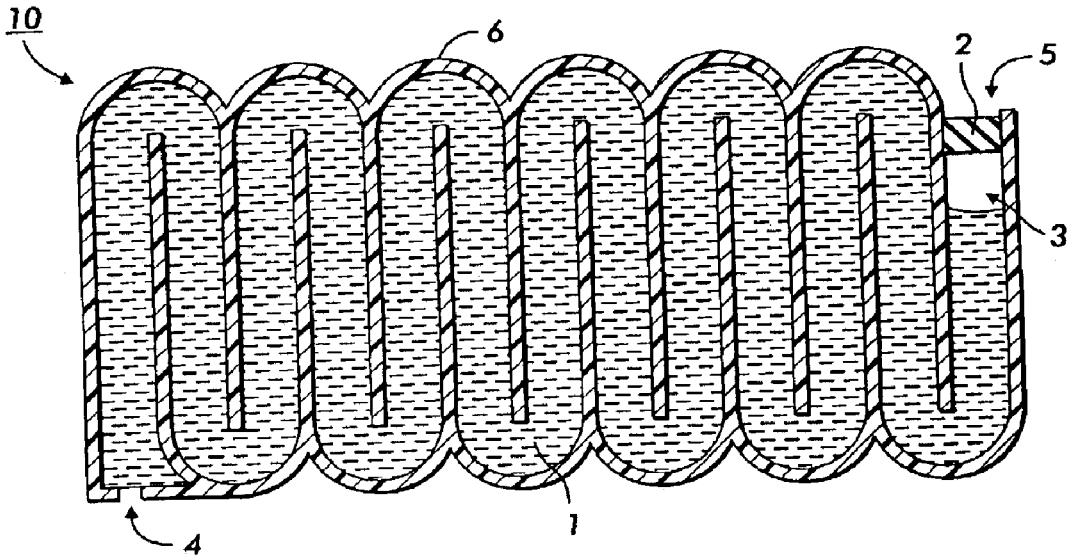
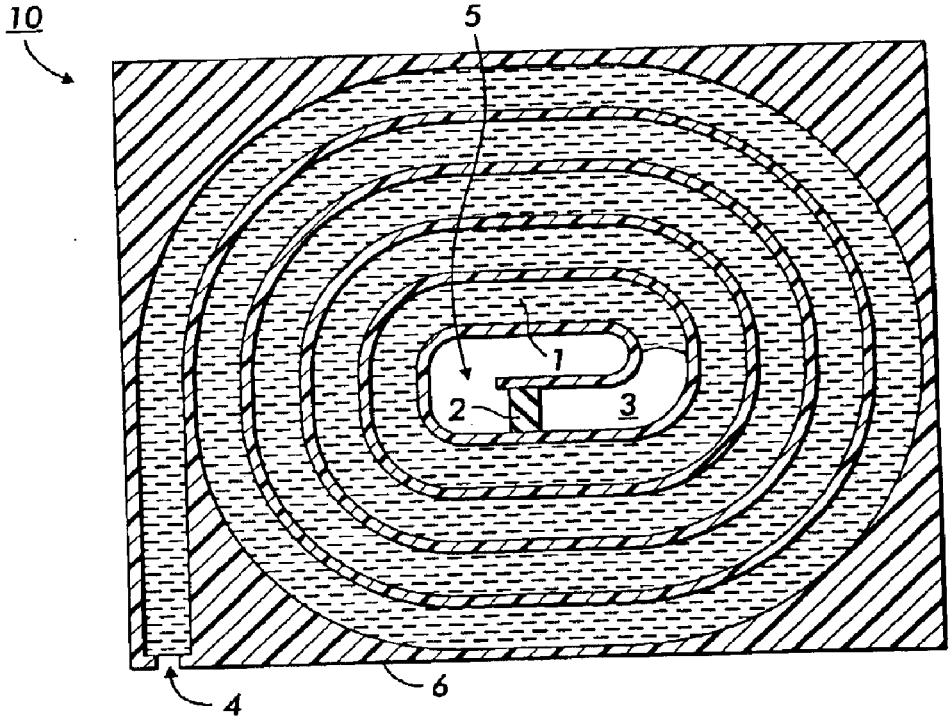
FIG. 2

LIQUID INK CARTRIDGE USING VISCOUS GEL

BACKGROUND OF THE INVENTION

1. Field of Invention

The invention relates to a liquid ink cartridge for a liquid ink image forming apparatus. The liquid ink cartridge uses a viscous gel seal that maintains the ink supply below atmospheric pressure to avoid undesired seeping of the ink from ink nozzles, particularly when the apparatus is idle. Thus, the present invention avoids the drying and clogging of the nozzles over extended periods of disuse.

2. Description of Related Art

A common design feature for all ink jet cartridges is a method to maintain a negative supply pressure. This negative pressure is needed so that ink will not be released out of the cartridge opening in a rest state. Generally, this negative pressure can be supplied by using any one of three different methods: 1) use of a foam capillary media to hold ink back, 2) use of a spring inside a bag to create a vacuum, and 3) placement of the ink container physically below the printing element.

The disadvantages of these methods include: 1) foam containers use an additional part that requires a difficult assembly operation. Foam containers may also deprime over time as the foam has a tendency to draw in a mix of air and ink; air trapped in the foam interrupts the flow of ink through the foam. As a result, foam containers generally have low ink delivery efficiency due to the amount of ink left in the foam at the end of the container's life. 2) A spring bag is expensive and will have a change in delivery pressure over the life of the container due to the spring rate of the material. 3) Placement of the ink container below the printing element is difficult to implement in many space constrained architectures and typically requires an umbilical system with connect and disconnect seals.

In ballpoint pens, the use of ink follower compositions, also known as "grease plugs," have been employed to prevent backleakage of the ink, inhibit evaporation of solvents and to reduce the risk of forming air gaps in the ink tube. Typically, ink followers are composed of a non-polar liquid, which is thickened to a grease-like consistency via the use of a thickener, and are positioned behind the ink supply. Such compositions also maintain negative pressure.

U.S. Pat. Nos. 3,526,522 and 3,656,857, to Seregely, disclose ink follower compositions containing a liquid vehicle and solid, microscopic grains or particles of organic plastic or polymer. U.S. Pat. No. 5,348,989, to Shiraishi, discloses ink volatilization-preventing compositions that contain a slightly volatile organic liquid, a gelling agent and a polyether-modified silicone.

These ink control plugs can sufficiently prevent the ink from leaking out when the aqueous ballpoint pens are positioned in a vertical or horizontal orientation, and they withstand a light drop impact. Of the light drop impacts, the strongest example is a case where the pen drops on a floor from a desk (about 70 cm). In this case, even a conventional ink follower scarcely gives rise to any trouble, through the ink follower slightly shifts.

SUMMARY OF THE INVENTION

Despite the above-described methods for providing a negative pressure in liquid ink cartridges, the need continues to exist for improved systems to provide negative pressure and improved leakage protection in such liquid ink cartridges, including but not limited to ink jet cartridges. Although various of the known methods have found acceptance in the art, improved methods and systems would for increased ink efficiency, in terms of less wasted ink, while providing increase cost effectiveness and increased reliability.

Furthermore, although ink control plugs are generally well known in the ballpoint pen art, such ink control plugs have not heretofore been applied in the liquid ink printing art. Although the principles of operation may be similar, liquid ink printing methods involve a wide range of concerns not present in ballpoint pen uses, including different ink characteristics, different printing mechanisms, and the like. The most significant difference is the difference in ink container construction. A ballpoint pen generally involves a straight, substantially linear, thin, cylindrical tube, whereas an ink jet ink container generally involves a larger, tank-shaped voluminous container.

The present invention thus provides a liquid ink cartridge that does not require the extra parts that a foam or spring bag design requires and has a high ink delivery efficiency. According to the present invention, the liquid ink cartridge includes a viscous gel seal, such as the kind used in ballpoint pens.

The seal maintains a negative pressure in the liquid ink cartridge, because as the ink reservoir is drained, the gel creates a vacuum because the gel resists the flow of the ink. In addition, such a liquid ink cartridge is simple to construct, as it requires no special assembly operation.

In embodiments, the present invention provides a liquid ink cartridge comprising:

a container defining a ink reservoir, said ink reservoir having an ink outlet at one end and capable of receiving a supply of ink in said ink reservoir; and an ink follower composition, said ink follower composition located in said ink reservoir apart from said ink outlet;

wherein said ink follower composition comprises a viscous gel or grease material that provides a negative pressure in said ink reservoir.

BRIEF DESCRIPTION OF THE DRAWINGS

Certain preferred embodiments of this invention will be described in detail, with reference to the following figures, in which:

FIG. 1 is an exemplary liquid ink cartridge incorporating a particular embodiment of the present invention and showing the internal structure.

FIG. 2 is an exemplary liquid ink cartridge incorporating another particular embodiment of the present invention and showing the internal structure.

DETAILED DESCRIPTION OF PREFERRED EMBODIMENTS

The liquid ink cartridge, such as an ink jet ink cartridge, of the invention has an ink "tube," capable of receiving and containing the ink supply, that is linked at one end to ink jet nozzles or other printing device by an ink outlet from which the ink is expelled during use, and a viscous gel plug applied at the other end. The viscous gel plug used is the same type of composition as those that may be typically used in a conventional ink follower in ballpoint pens.

Referring to FIG. 1, the interior of a liquid ink cartridge 10, is shown. The ink supply 1 is contained within an ink supply tube 6, which forms an ink reservoir. The ink supply tube 6 within the cartridge 10 may be arranged in a sufficiently narrow continuous path, such as, for example, a serpentine or spiral shape. Other arrangements of the ink supply tube may also be used as required, for example, by the form of the cartridge. Multiple tubes may also be used as appropriate, for example to increase the amount of ink available or where inks of different colors or other different characteristics (e.g., photo-grade inks) may be contained in a single liquid ink cartridge. The ink outlet end 4 of the ink supply tube 6 may be connected to the printhead of the image forming apparatus either directly or via a connecting member. The ink follower 2 is located at the vent end 5 of the ink supply tube 6. The vent end 5 of the ink supply tube 6 is open to the atmosphere and thus is maintained at the atmospheric pressure of the surrounding ambient environment.

In the particular embodiment depicted, the ink follower 2 is shown separated from the ink supply 1 by an optional air gap 3. The air gap 3 may be included depending on the compatibility of the ink with the ink follower composition. Where the formulation of the ink is such that the ink follower composition would be solubilized by or otherwise react or interact with the ink, it may be desirable to leave an air space between the ink and the ink follower. The air gap between the ink follower and the ink acts as a "spring" for the system. As the container is drained, the ink follower resists the flow, and thereby creates a pocket of negative pressure to keep the ink from weeping out the nozzles. As the ink supply is consumed, the negative pressure also pulls the follower through the ink supply tube. Thus, the negative pressure remains fairly consistent as the ink supply is drained. The air gap also buffers the system from minor shocks and minimizes the formation of air pockets within the ink supply that may result from such shocks. The inclusion of an air gap 3 also enhances the creation of negative pressure.

An alternative embodiment is shown in FIG. 2. In FIG. 2, similar reference numbers are used to depict similar parts to the embodiment shown in FIG. 1. However, in FIG. 2, the ink supply tube or reservoir 6 is shown to have a spiral (or snail-like) shape. In this embodiment, the ink outlet 4 is similar to that depicted in FIG. 1, but the vent end 5 is located in the central portion of the liquid ink cartridge. In such an arrangement, the vent end 5 can be open to the atmosphere by any conventional means including, for example, a suitable vent hole (not shown, but which would be in the plane of the paper as shown in FIG. 2) in the side of the liquid ink cartridge.

The size of the ink supply tube 6 as well as the characteristics of the follower composition such as, for example, viscosity, are determined by features such as the ink capacity desired for the liquid ink cartridge 10 and/or the size and shape of the openings of the print head. Thus, a follower composition should be selected based, as least in part, on the characteristics of the liquid ink container. In the embodiment shown, the ink supply tube 6 is arranged to fit within the housing of a liquid ink cartridge 10 having a rectangular shape. However, the ink supply tube 6 may be arranged to fit in other housing shapes, as dictated by the design of the particular liquid ink cartridge.

The ink container 10 is preferably molded from thermoplastic resins, such as polyethylene, polypropylene, and polyethylene terephthalate. The container may be transparent, colored transparent, semitransparent or opaque. Having the container be transparent, colored transparent, or semitransparent, however, makes it possible for the user to confirm the color or the residual amount of the ink and also produces a unique design effect.

Generally, the ink follower for use in the present invention can be any suitable ink follower, including those that have previously been used in the art of ballpoint and similar pens. In embodiments, the ink follower can be any suitable viscous gel or other composition, which provides the properties of providing a sealing effect in the ink reservoir, and providing a negative pressure in the ink reservoir as the ink is drained.

In one particular embodiment of the present invention, the ink follower comprises a suitable non-polar liquid, a thickener, and an optional polar additive.

Examples of non-polar liquids that can be used in the present ink follower compositions include grease materials, such as mineral oils, animal and vegetable oils, esters, high-boiling hydrocarbons, higher fatty acids, higher alcohols and low-molecular weight polyolefins. Typical examples include vaseline, spindle oil, castor oil, olive oil, liquid paraffin and polybutene having a number average molecular weight of from about 300 to about 3000. The amount of the non-polar liquid to be used is in the range of from about 40 to about 90% by weight, preferably from about 90 to about 97% by weight with respect to the total weight of the ink follower composition.

In particularly useful compositions, combinations of high molecular weight and low molecular weight polybutenes are used as the non-polar liquid component. By high molecular weight polybutene it is meant polybutene having a number average molecular weight greater than about 900. By low molecular weight polybutene it is meant polybutene having a number average molecular weight less than about 900, preferably less than about 500. A suitable high molecular weight polybutene is available under the designation "H-100" from Amoco Inc. A suitable low molecular weight polybutane is available under the designation "L-100" from Amoco Inc. The ratio of high molecular weight polybutene to low molecular weight polybutene should be at least about 2:1. Where a polar additive (as described hereinafter) is not employed, the ratio of high molecular weight polybutene to low molecular weight polybutene should be at least about 3:1. Alone, the individual polybutenes used to make the mixture might be too fluid or too waxy. In the-above-described ratios, however, it has been discovered that the mixture of high and low molecular weight polybutenes provide ink follower compositions that exhibit desired flow characteristics.

In another aspect, ink follower compositions described herein include polybutene mixed with mineral oil as the non-polar liquid. The polybutene alone can be somewhat tacky and may adhere to the ink tube. However, it has been discovered that a mixture of polybutene and mineral oil provides a good, grease-like consistency while avoiding undesirable adherence of the ink follower composition to the ink tube. In a particularly useful composition mineral oil is used in combination with the above described mixture of polybutenes.

Examples of thickeners that can be used in the present ink follower compositions include microparticle silica, metallic soaps such as magnesium stearate, calcium stearate, aluminum stearate and zinc stearate, inorganic pigments such as bentonite and carbon black, and organic pigments. The amount of the thickener to be used is preferably in the range of from 0.1 to about 15% by weight, preferably from about 2 to about 10% by weight with respect to the total weight of the ink follower composition.

The third component that is preferably included in the present ink follower compositions, but which is optional and can thus be excluded, if desired, is an additive with high polarity. The addition of a polar additive promotes affinity between the ink follower and the ink, particularly when water-based inks, which possess a high degree of polarity, are used, and minimizes the tendency of the ink follower to adhere to the walls of the ink tube. Suitable polar additives include non-ionic surfactants and low molecular weight alcohols.

When a non-ionic surfactant is chosen as the polar additive, consideration should be given to the compatibility of the surfactant with the non-polar liquid(s) in the composition and to the temperatures to be used in processing the ink follower. Thus, for example, where aluminum stearate is used as the thickener, temperatures up to 180° C. may be required during processing. Where clay thickeners are used, processing at room temperature is possible. Ethoxylated nonylphenols are particularly useful non-ionic surfactants in that they are compatible with a wide variety of non-polar liquids and can withstand a wide range of processing temperatures. One example of a suitable non-ionic surfactants is available under the designation IGEPAL RC-52 from Rhone Poulene, Inc., Cranbury, N.J.

Low molecular weight hydroxyl-containing compounds can also be used as the polar additive in the present compositions. Suitable compounds include those of the formula R—OH wherein R is hydrogen or $C_1$ to $C_5$ alkyl. The choice of hydroxyl-containing compound will depend in some cases on the thickener employed. Thus, for example, where certain clays are used as the thickeners, water can serve as the polar additive. Ethanol and isopropanol are useful with a wide variety of thickeners and are the preferred polar additive, in embodiments.

Other, optional ingredients may also be incorporated into the present ink follower compositions. By way of example, a silicone oil or silicone wax can be added to the present compositions. See also, for example, U.S. Pat. No. 6,200,053, to Asami et al., which discloses additional compositions and additives for ink follower compositions. Such ink follower compositions and additives are equally applicable to the ink follower composition employed in the present invention, and thus the entire disclosure of the patent is incorporated herein by reference.

The compositions described herein can be prepared by adding the thickener and any polar additive or other ingredients to the non-polar liquid and mixing or kneading to provide a homogeneous mixture. Heating can be used to facilitate mixing when desired or necessary. The resulting compositions normally have a grease-like consistency.

The ink follower according to the invention is applied at the rear end of the ink filling a liquid ink cartridge and is to follow the ink with ink consumption while preventing evaporation of the ink and back flow of the ink even when the liquid ink cartridge is stored upside-down or in case of a shock. The ink follower composition of the invention may also be used in combination with a known solid ink follower.

In embodiments of the present invention, the ink follower can be either permanently set in place in the ink reservoir, it can be semi-permanently set in place in the ink reservoir, or it can be placed in the ink reservoir in a manner such that the ink follower can move through the ink reservoir as the ink supply is depleted. Thus, for example, the ink follower can be permanently placed in the ink reservoir such that the ink follower remains set in its initial location, despite ink depletion and/or customary movement of the liquid ink cartridge (i.e., shaking, jostling, bumping, and the like). Alternatively, the ink follower can be semi-permanently placed in the ink reservoir such that the ink follower generally remains set in its initial location, although it may move slightly depending upon ink depletion and/or customary movement of the liquid ink cartridge. This latter arrangement is typically employed in ballpoint pens, i.e., the ink follower generally does not move, although some movement can occur if the pen is dropped, and the like. Still further, the ink follower can be placed in the ink reservoir such that the ink follower moves through the ink reservoir. In this embodiment, the ink follower "follows" the ink as the ink supply is depleted, thereby creating a relatively constant empty volume between the remaining ink supply and the ink follower. These various alternatives will be readily understood by one of ordinary skill in the art in view of the present disclosure.

The present invention can be used to form a liquid ink cartridge suitable for use with a wide variety of liquid inks and in ink jet or other liquid ink printing processes. Thus, the present invention is not limited to any particular ink jet ink composition, or to any particular ink jet printing process.

EXAMPLES

The following examples are presented to illustrate specific embodiments of the present compositions. These examples should not be interpreted as limitations upon the scope of the invention.

Example 1

An ink follower of the following composition is prepared:

| | Weight Percent |
|---|---|
| Polybutene | 47.7 |
| Mineral Oil | 47.7 |
| Bentone 34 (Clay) | 2.8 |
| Ethanol (95% solution) | 1.8 |

Example 2

An ink follower of the following composition is prepared.

| | Weight Percent |
|---|---|
| Polybutene | 97.6 |
| Fumed Silica | 2.3 |
| Ethoxylated Nonylphenol | 0.1 |

Examples 3–6

The ink follower compositions listed in Table I are prepared using a mixture of high and low molecular weight polybutenes and aluminum stearate as the thickener. All values given in this and other examples are weight percent.

TABLE I

| | Ex. 3 | Ex. 4 | Ex. 5 | Ex. 6 |
|---|---|---|---|---|
| Polybutene H-100 | 81.14 | 70.92 | 60.75 | 61.12 |
| Polybutene L-100 | 15.50 | 19.84 | 29.98 | 29.98 |

TABLE I-continued

| | Ex. 3 | Ex. 4 | Ex. 5 | Ex. 6 |
|---|---|---|---|---|
| Aluminum Stearate 22* | 3.36 | 6.35 | 6.84 | 6.74 |
| Aluminum Stearate 30* | — | 2.90 | 2.28 | 2.00 |
| Ethoxylated Nonylphenol | — | — | 0.15 | 0.15— |
| Ratio of H/100-L/100 | 5.1/1.0 | 3.6/1.0 | 2.0/1.0 | 2.0/1.0 |

*Witco Inc., Akron, Ohio.

In preparing the compositions of Examples 3–6, the polybutene and aluminum stearate are heated to a temperature sufficient to melt the aluminum stearate and thereby ensure good mixing. Upon cooling, each of the formulations presented in Table I have a good, grease-like texture.

Examples 7–11

Table II presents further examples of ink follower compositions containing mixtures of polybutenes in accordance with this disclosure.

TABLE II

| | Ex. 7 | Ex. 8 | Ex. 9 | Ex. 10 | Ex. 11 |
|---|---|---|---|---|---|
| Polybutene H-100 | 81.14 | 66.91 | 77.89 | 79.59 | 80.20 |
| Polybutene L-100 | 15.50 | 13.13 | 13.06 | 14.50 | 15.04 |
| Aluminum Stearate 22 | 3.36 | 3.29 | 4.02 | 4.00 | 4.01 |
| Mineral Oil | — | 16.67 | — | — | — |
| Silicone Oil | — | — | 5.03 | — | 0.50 |
| Atlas G-711* | — | — | — | 2.0 | — |
| Ethoxylated Nonylphenol | — | — | — | — | 0.25 |

*Alkyl acryl sulfonate amine salt available from ICI Ame. Inc., Wilmington, DE.

Examples 12 and 13

Ink follower compositions containing polybutene and mineral oil (but no polar additive) are prepared having the following formulations:

| | Ex 12 | Ex 13 |
|---|---|---|
| Polybutene H-100 | 40.66 | 35.94 |
| Aluminum Stearate 22 | 3.37 | 3.37 |
| Mineral Oil | 54.91 | 60.69 |
| Silicone Wax | 1.06 | — |

Examples 14–26

Liquid ink cartridges are prepared using the ink follower compositions of Examples 1–13, respectively. Liquid ink cartridges are including a generally serpentine-shaped ink reservoir, as shown in FIG. 1. The liquid ink cartridges thus prepared may be used in, for example, a conventional ink jet printer to produce images with varying idle times throughout the printing process. The liquid ink cartridges and resultant images are periodically examined to determine print quality of the resultant image, ink leakage out of the ink liquid cartridge, plugging of the ink jet nozzles, and the like.

Comparative Examples 1–3

Conventional liquid ink cartridges are obtained that utilize conventional methods for providing negative pressure in the ink reservoir. In Comparative Example 1, the cartridge includes a foam capillary media that retains the ink within the ink reservoir. In Comparative Example 2, the cartridge includes a spring inside a bag. In Comparative Example 3, the cartridge does not include any particular negative pressure device, but the ink cartridge is located below the print head of the printer, and connected to the print by a suitable connection device.

The liquid ink cartridges may be used, for example, in a conventional ink jet printer to produce images with varying idle times throughout the printing process in the same manner as described for Examples 14–26. The liquid ink cartridges and resultant images are periodically examined as in Examples 14–26 to determine print quality of the resultant image, ink leakage out of the liquid ink cartridge, plugging of the ink jet nozzles, and the like.

The results of Examples 14–26 and Comparative Examples 1–3 indicate that the liquid ink cartridges prepared using the ink follower compositions of the present invention provide acceptable properties, comparable to or better than the properties provided by the conventional liquid ink cartridges.

Those skilled in the art after reading the above description will identify various modifications that can be made to the embodiment described above without departing from the spirit of the invention. For example, other shapes of ink cartridges may incorporate the invention. Also, other formulations of the ink follower composition may be used depending on the composition of the ink. In addition, the locations of the vent end, the outlet opening, and other elements may be placed or arranged differently as needed or desired. Therefore, the above description is illustrative, and the scope of the invention is not to be limited to the embodiment described above.

What is claimed is:

1. A liquid ink cartridge comprising:

a container defining an ink reservoir, said ink reservoir having an ink outlet at one end and capable of receiving a supply of ink in said ink reservoir; and an ink follower composition, said ink follower composition located in said ink reservoir apart from said ink outlet;

wherein said ink follower composition comprises a viscous gel material or grease material that provides a negative pressure in said ink reservoir;

wherein said ink reservoir is in a form of a tubular passageway; and wherein said tubular passageway has an arrangement selected from the group consisting of serpentine-shaped, annular-shaped, and spiral-shaped.

2. The liquid ink cartridge of claim 1, wherein said ink follower composition is located at an opposite end of said tubular passageway from said ink outlet.

3. The liquid ink cartridge of claim 1, wherein the ink follower composition contacts ink in the ink reservoir.

4. The liquid ink cartridge of claim 1, wherein said ink follower composition comprises:

a non-polar liquid; and a thickener.

5. The liquid ink cartridge of claim 4, wherein said non-polar liquid composition is selected from the group consisting of mineral oils, animal and vegetable oils, esters, high-boiling hydrocarbons, higher fatty acids, higher alcohols and low-molecular weight polyolefins.

6. The liquid ink cartridge of claim 5, wherein said non-polar liquid composition is selected from the group consisting of vaseline, spindle oil, castor oil, olive oil and liquid paraffin.

7. The liquid ink cartridge of claim 4, wherein said ink follower composition is located at an opposite end of said tubular passageway from said ink outlet.

8. The liquid ink cartridge of claim 4, wherein the ink follower composition contacts ink in the ink reservoir.

9. The liquid ink cartridge of claim 4, wherein the ink follower composition contains from about 40 to about 98 weight percent of the non-polar liquid.

10. The liquid ink cartridge of claim 4, wherein the non-polar liquid includes a mixture of high molecular weight polybutene and low molecular weight polybutene.

11. The liquid ink cartridge of claim 10, wherein a ratio of high molecular weight polybutene to low molecular weight polybutene is at least about 2:1.

12. The liquid ink cartridge of claim 10, wherein the high molecular weight polybutene has a number average molecular weight greater than about 900 and the low molecular weight polybutene has a number average molecular weight of less than about 900.

13. The liquid ink cartridge of claim 4, wherein the ink follower composition contains from about 0.1 to about 10 weight percent of the thickener.

14. The liquid ink cartridge of claim 13, wherein the thickener of the ink follower composition is a metal soap.

15. The liquid ink cartridge of claim 4, wherein the ink follower composition further comprises a polar additive.

16. The liquid ink cartridge of claim 15, wherein the ink follower composition contains from about 0.01 to about 5 weight percent of the polar additive.

17. The liquid ink cartridge ink follower composition of claim 16, wherein the non-ionic surfactant of the ink follower composition is ethoxylated nonylphenol.

18. The liquid ink cartridge of claim 15, wherein the polar additive is selected from the group consisting of non-ionic surfactants and water.

19. A liquid ink cartridge comprising:

a container defining an ink reservoir, said ink reservoir having an ink outlet at one end and capable of receiving a supply of ink in said ink reservoir; and an ink follower composition, said ink follower composition located in said ink reservoir apart from said ink outlet;

wherein said ink follower composition comprises a viscous gel material or grease material that provides a negative pressure in said ink reservoir; and wherein an air gap separates the ink follower composition from ink in the ink reservoir.

20. A liquid ink cartridge comprising:

a container defining an ink reservoir, said ink reservoir having an ink outlet at one end and capable of receiving a supply of ink in said ink reservoir; and an ink follower composition, said ink follower composition located in said ink reservoir apart from said ink outlet;

wherein said ink follower composition comprises a viscous gel material or grease material that provides a negative pressure in said ink reservoir;

wherein said ink follower composition comprises:

a non-polar liquid; and a thickener; and wherein an air gap separates the ink follower composition from ink in the ink reservoir.

* * * * *